US005584289A

United States Patent [19]

Wise

[11] Patent Number: 5,584,289

[45] Date of Patent: Dec. 17, 1996

[54] BREATHING APPARATUS HAVING A FLEXIBLE MANIFOLD CONNECTED BETWEEN A PLURALITY OF AIR CYLINDERS

[75] Inventor: Layton A. Wise, Washington, Pa.

[73] Assignee: Mine Safety Appliances Company, Pittsburgh, Pa.

[21] Appl. No.: 481,583

[22] Filed: Jun. 7, 1995

[51] Int. Cl.[6] ..... A62B 9/02; A62B 9/04

[52] U.S. Cl. ..... 128/205.24; 128/205.22; 128/205.25; 128/206.28; 128/207.12

[58] Field of Search ..... 128/205.24, 204.18, 128/205.22, 200.24, 205.25, 206.28, 207.12

[56] References Cited

U.S. PATENT DOCUMENTS

| | | | |
|---|---|---|---|
| 764,709 | 7/1904 | Chapin et al. | 128/201.23 |
| 2,122,897 | 7/1938 | Straw | 128/204.18 |
| 2,764,151 | 9/1956 | Cupp | 128/205.22 |
| 3,791,403 | 2/1974 | Folkerth | 137/343 |
| 4,062,356 | 12/1977 | Merrifield | 128/205.22 |
| 4,383,528 | 5/1983 | Eppolito | 128/204.18 |
| 4,440,164 | 4/1984 | Werjefelt | 128/205.25 |
| 4,722,333 | 2/1988 | Bartos | 128/202.27 |
| 5,396,885 | 3/1995 | Nelson | 128/204.18 |

FOREIGN PATENT DOCUMENTS

| | | | |
|---|---|---|---|
| 1133251 | 7/1962 | Germany | 128/202.22 |
| 72888 | 12/1916 | Switzerland | 128/201.25 |
| 234304 | 1/1945 | Switzerland | 128/205.22 |

*Primary Examiner*—Edgar S. Burr
*Assistant Examiner*—Daniel J. Colilla
*Attorney, Agent, or Firm*—James G. Uber; Paul D. Bangor, Jr.

[57] ABSTRACT

A self-contained breathing apparatus having two or more air storage cylinders, each of the cylinders in gas-flow communication with a flexible manifold which is in gas-flow communication with a facepiece. Preferably, the flexible manifold includes a manifold unit connected to a flexible conduit for each of the cylinders such that the manifold unit is located at least partially within an envelope defined by the cylinders. Preferably the other main high pressure operating components are also connected to the manifold unit, including the regulator, pressure gauge, cylinder valve and wheel, pressure relief rupture disk, and low pressure alarm such that they are at least partially, more preferably substantially, and most preferably totally disposed within an envelope defined by the exterior surfaces of at least two of the plurality of cylinders.

18 Claims, 6 Drawing Sheets

10
11
12
12'
12"
13
14
15
17
18
20
21
22
22A
24
29
30
32
35
36
36A
37
38
40
42
46
48
49
50
51
71
72

FIG. 7
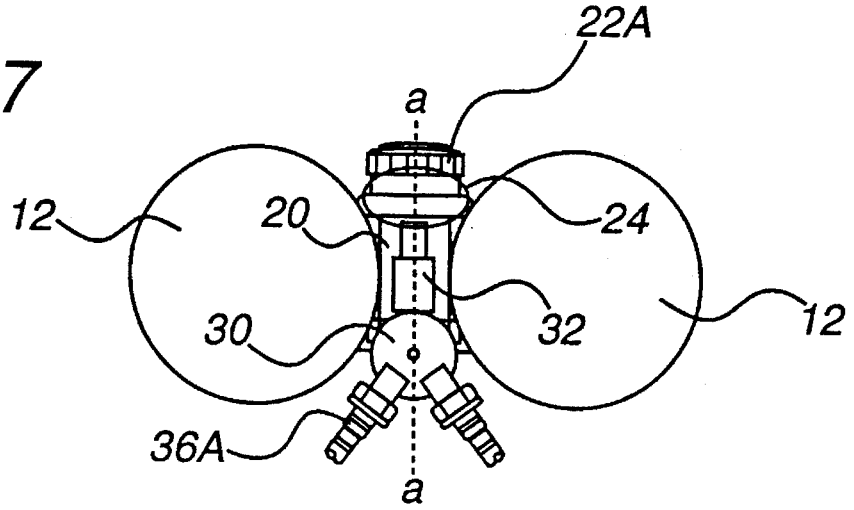
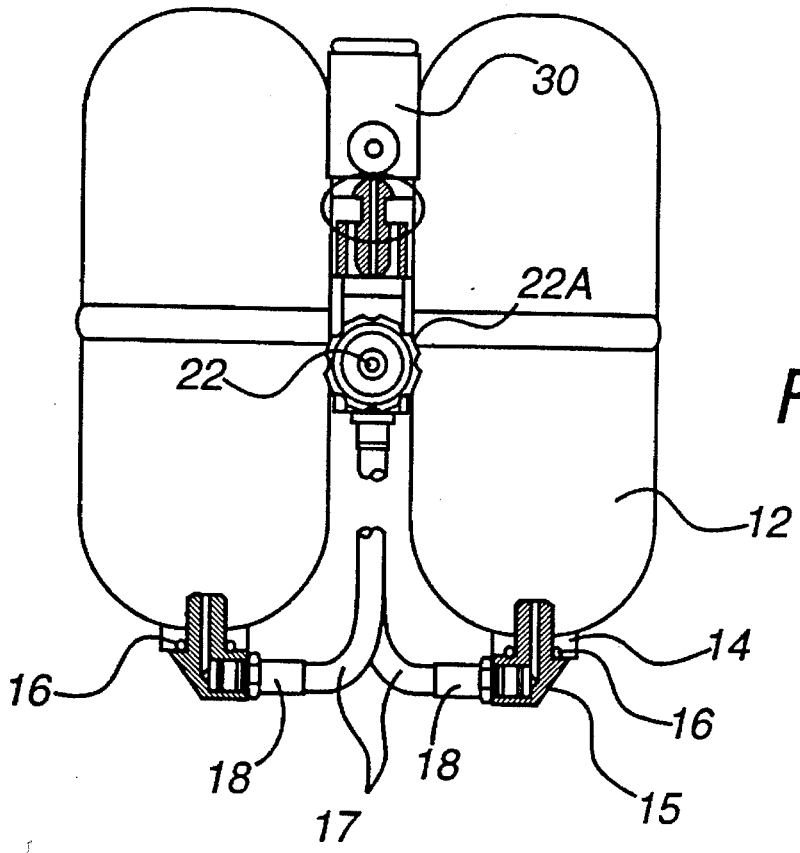
FIG. 8

BREATHING APPARATUS HAVING A FLEXIBLE MANIFOLD CONNECTED BETWEEN A PLURALITY OF AIR CYLINDERS

FIELD OF THE INVENTION

The present invention relates to a breathing apparatus, and more particularly, to a breathing apparatus having a flexible manifold connected between two or more gas storage cylinders. The breathing apparatus can be used alone as a Self-Contained Breathing Apparatus (SCBA) or in conjunction with an external air supply such as a Supplied-Air Respirator (SAR),

BACKGROUND OF THE INVENTION

It is known to use a single-cylinder SCBA as an escape breathing apparatus, allowing a user to escape from environments that pose an Immediate Danger to Life or Health (IDLH). See the Premaire® Cadet Respirator made by the Mine Safety Appliances Company (MSA) of Pittsburgh, Penn. (MSA Data Sheet No. 01-00-04). Generally, such single-cylinder SCBA's used as an escape breathing apparatus employ air cylinders which provide a minimum air supply of five minutes up to a maximum air supply of about ten minutes. The actual duration of the air supply in a particular situation varies according to a number of factors, such as age, weight, physical condition, and breathing rate of the user of the SCBA. It is generally understood that five to ten minutes of air supply is sufficient time for escape from most environments likely to be encountered by a user of an escape breathing apparatus. Nonetheless, in certain situations it would be desirable to increase the air supply of an escape breathing apparatus to greater than ten minutes.

It is known to use an SCBA having a single air cylinder as an entry or escape device provided it has more than a fifteen minute supply of air. See the TransportAire™ Portable Air Supply System from MSA (Data Sheet No. 01-05-02). A minimum air supply of fifteen minutes is required for an SCBA to be approved by the National Institute for Occupational Safety and Health (NIOSH) for use for both entering and escaping IDLH environments. Such single-cylinder SCBA's, however, are generally too large and bulky to be worn in certain IDLH environments such as confined spaces.

It is also known to use an SCBA having multiple small air cylinders for use as an entry or escape breathing device which provide more than a fifteen-minute air supply. Such a product is made by Respiratory Devices, Inc. and is sold under the trademark Lifeair. There are certain disadvantages inherent in the design and construction of such SCBA's which become apparent when these devices are used in certain IDLH environments such as confined spaces.

Generally, these dual-cylinder SCBA's have a forged, rigid connection between the air cylinders which also serves as the air manifold. The rigid metal manifold also produces an SCBA with a higher profile than desired for maneuvering in confined spaces. Moreover, such a rigid connection dictates a placement of the pressure gauge and valve wheel where they are susceptible to being damaged or rendered inoperable if the unit is dropped or struck such as is likely to occur in a confined space. In addition, the necks of the air cylinders of these SCBA's are less capable of accepting shock loading without over-stressing due to the rigid manifold connecting the air cylinders.

It would be desirable to have a light-weight, lower-profile SCBA having multiple small cylinders which can provide an air supply of at least fifteen minutes for use in both entering and escaping from an IDLH environment and particularly one in a confined space.

It would also be desirable to have a multi-cylinder SCBA wherein substantially all of the high pressure operating components, such as the pressure gauge, cylinder valve and wheel, pressure relief rupture disk, high pressure regulator and low-pressure alarm could be located substantially within the envelope created by the cylinders, where such components are much less susceptible to being damaged or rendered inoperable if the unit is dropped or bumped.

SUMMARY OF THE INVENTION

Generally, the present invention provides a self-contained breathing apparatus comprising a plurality of air storage cylinders, each of the cylinders in gas-flow communication with a flexible manifold which in turn is in gas-flow communication with a facepiece for delivering gas to a user of the breathing apparatus. The flexible manifold preferably comprises a flexible conduit for each of the cylinders and a manifold unit, preferably a block, located at least partially within an envelope defined by the cylinders. Preferably, all of the main high pressure operating components, including the pressure gauge, cylinder valve and wheel, pressure relief rupture disk, high pressure regulator and low-pressure alarm are connected to the manifold unit and are at least partially, more preferably substantially, and most preferably totally disposed within an envelope defined by the exterior surfaces of at least two of the plurality of cylinders.

The present invention further comprises a pouch for carrying the air storage cylinders and the flexible manifold, as well as a connector for attaching the cylinders to the manifold unit such that the flexible manifold remains in the desired protected position when the breathing apparatus is removed from the pouch.

Other details and advantages of the present invention will become apparent from the following detailed description of the presently preferred embodiments of practicing the invention.

BRIEF DESCRIPTION OF THE DRAWINGS

In the accompanying drawings, preferred embodiments of the invention and preferred methods of practicing the invention are illustrated in which:

FIG. 7 is a top plan view of an air supply of the present invention illustrating a preferred embodiment thereof wherein substantially all of the main high pressure operating components are located substantially within an envelope defined by the exterior surfaces of the air cylinders.

FIG. 8 is a front elevational view of an air supply of the present invention showing the cylinder inlet and necks of the air cylinders in cross-section.

DETAILED DESCRIPTION OF TEE PREFERRED EMBODIMENTS

The present invention is described with respect to the preferred physical embodiments constructed in accordance herewith. It will be apparent to those of ordinary skill in the art that various modifications and improvements may be made without departing from the scope and spirit of the invention. Accordingly, the invention is not limited by the specific embodiments illustrated and described, but only by the scope of the appended claims, including all equivalents thereof.

Figures 1, 2:
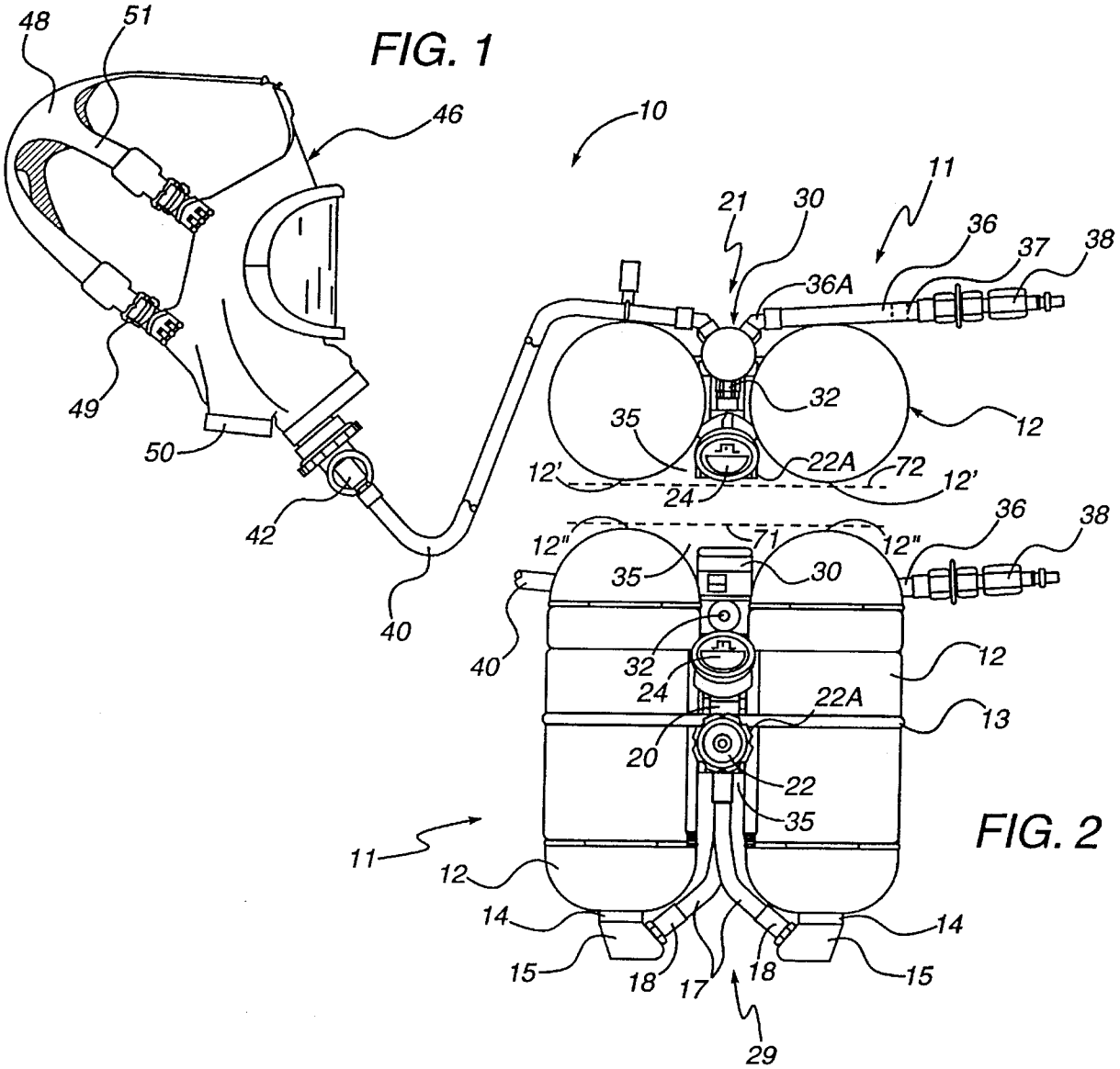
FIG. 1 is a schematic view of a breathing apparatus of the present invention.
FIG. 2 is a front elevational view of the air supply of a breathing apparatus of the present invention.

As illustrated in FIGS. 1 and 2, a preferred embodiment of the breathing apparatus 10 of the present invention comprises a self-contained air supply, generally 11, in gas-flow communication with facepiece/mask, generally 46, via a flexible manifold, generally 29. As used herein, the term "air" is intended to embrace natural, or true air which has been compressed, as well as any other gas or gas/air mixture adapted for sustaining life.

In another preferred embodiment of the present invention, some of the components of the breathing apparatus 10, such as the mask 46, second stage regulator 42 and first stage regulator 30, may be used as an SAR when connected to an external air supply via a low-pressure hose 36, stainless steel couplings 36A and 38 and an external air supply hose (not shown). Thus, the breathing apparatus 10 may be employed as an SCBA or a combination SCBA/SAR. Either preferred embodiment of the breathing apparatus 10 of the present invention can be used in an IDLH environment and particularly those in confined spaces.

A preferred embodiment of the breathing apparatus 10 of the present invention, useful as an SCBA as illustrated in FIGS. 1–9, comprises:

- a facepiece 46 with a multi-point adjustable head harness 48 having (preferably five) straps 51 threaded through slotted grommets 49 which allow for adjustment of the size of the head harness 48, and an exhalation valve 50;
- a mask-mounted second-stage regulator 42 that regulates breathable air entering the mask 46;
- a plurality of air storage cylinders 12 of a fully-wound composite construction with a 3,000 psig service rating;
- a first stage pressure regulator 30 for the regulation of air from the high pressure air cylinders 12;
- a cylinder control valve 22 with hand wheel 22A for the manual control of the flow of air between the storage cylinders 12 via high pressure hoses 17 and the manifold block 20;
- a pressure gauge 24 with an easily readable, phosphorescent background dial 24A;
- a low-pressure alarm 32, such as the Audi-alarm audible low pressure warning device available from MSA, for continuous warning of low cylinder air pressure conditions;
- a carrier pouch 54 for the air supply 11 with an adjustable shoulder strap 56 and an adjustable waist strap 58.

Another preferred embodiment of the breathing apparatus 10 of the present invention useful, in conjunction with an external air supply (not shown) and an external air supply hose (also not shown), as a combination SAR/SCBA further comprises:

- a low-pressure hose 36 having a first end in gas-flow communication with the regulator 30 via coupling 36A, a stainless steel coupling 38 disposed on the second end of the hose 36, and a check valve 37 disposed within the hose 36 between its first and second ends and preferably near the second end thereof.

The air supply 11 of breathing apparatus 10 is ruggedly designed with the main operating components of the breathing apparatus 10, including the pressure gauge 24, cylinder control valve 22, control valve hand wheel 22A, pressure relief rupture disk 26, high pressure regulator 30, manifold block 20, and low-pressure alarm 32, preferably located at least partially, more preferably substantially, and most preferably totally within the volume or envelope 35 defined, for example, by imaginary planes 71, 72 drawn tangent to the uppermost and outward-most facing surfaces, 12' and 12", respectively, of both cylinders 12 (See FIGS. 1 and 2).

Figure 4:
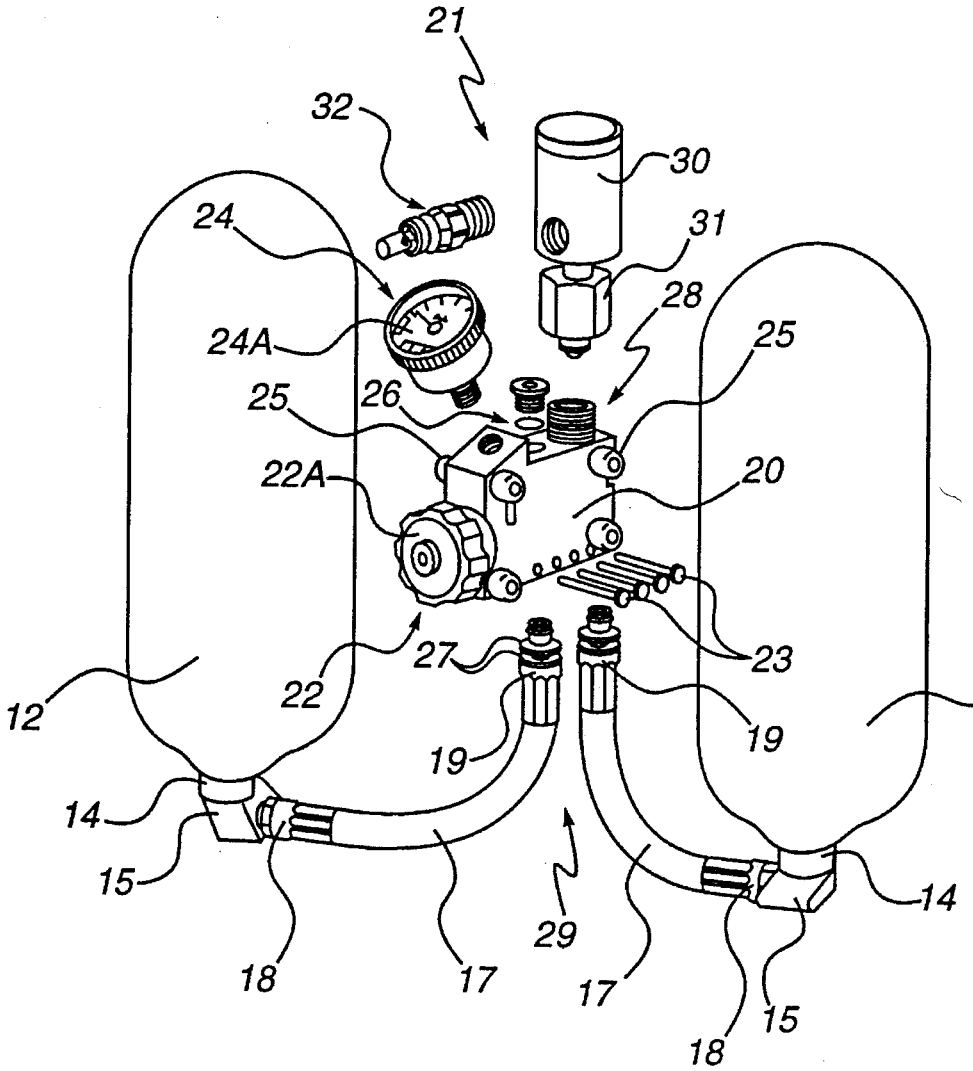
FIG. 4 is an exploded perspective view of an air supply of the present invention.
Figure 9:
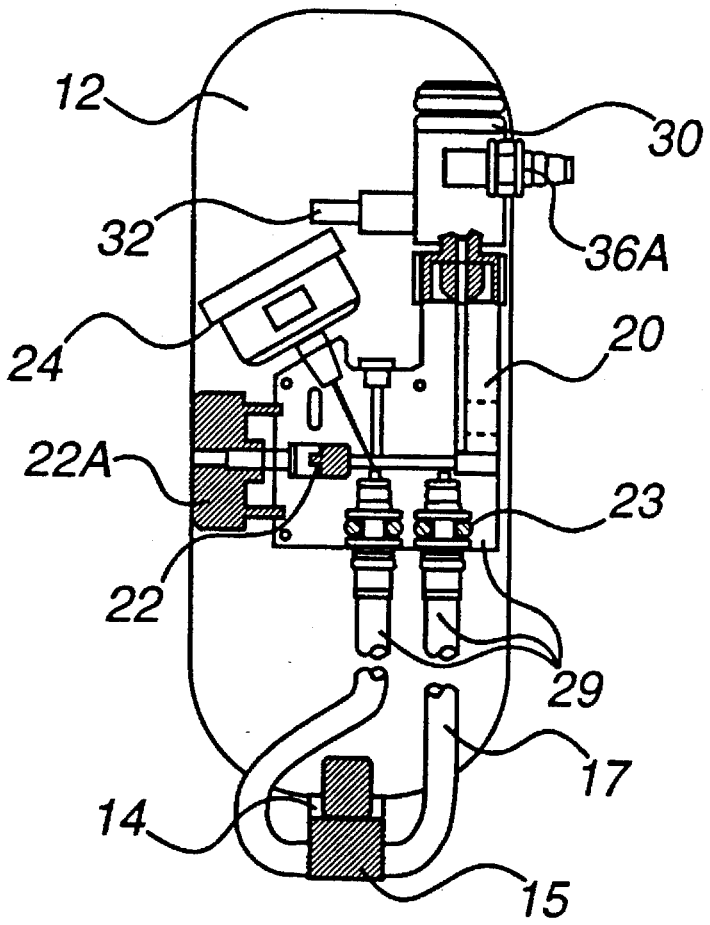
FIG. 9 is a cross-sectional view of an air supply of the present invention along line a—a of FIG. 7.

The cylinders 12 are preferably connected in gas-flow communication to the flexible manifold 29 which preferably comprises a manifold unit 21 and one or more flexible high pressure conduits 17 which preferably are hoses (See FIG. 9). As seen in FIGS. 4, 8 and 9, the hoses 17 are connected to the cylinders 12 at the cylinder inlet 15 via the couplings 18. 0-rings 16 are placed between the cylinder inlets 15 and the necks 14 of the cylinders to prevent leakage of air therefrom (See FIG. 8). The other ends of hoses 17 are connected to the manifold block 20 via couplings 19, each of which include spaced-apart flanges 27 on the hose fittings, as shown in FIG. 4. After the couplings 19 are threaded into openings in the bottom of manifold block 20, high pressure hose screws 23 are preferably used to further secure the connection between the hoses 17 and the manifold block 20.

The use of the flexible manifold 29 of the present invention allows for the placement of manifold unit 21 substantially or completely within the envelope 35 and produces many advantages over other known breathing devices. For example, the reduced height of the air supply 11 of the present invention provides a lower profile than the height of known air supplies wherein the cylinders are joined by a rigid manifold/connector which extends significantly above the envelope 35 as previously defined. Other advantages resulting from the use of the flexible manifold 29 of the present invention include:

- a lighter-weight air supply 11, resulting from the omission of the rigid manifold/connector which is substantially heavier than the combination of the manifold unit 20 and the high pressure hoses 17, while still providing an air supply of at least fifteen minutes for use in both entering and escaping from an IDLH or oxygen deficient environment;
- placement of all, or substantially all, of the main high pressure operating components of the breathing apparatus 10, including the pressure gauge, cylinder valve, cylinder valve hand wheel, pressure relief rupture disk, high pressure regulator and low-pressure alarm, within the envelope 35 where such components are much less susceptible to being damaged or rendered inoperable if the air supply 11 is dropped or struck in a confined space; and
- acceptance of shock loading by the necks 14 of the air cylinders 12 without over-stressing.

While most any type of high pressure air cylinders can be employed, the air supply 11 of the present invention most preferably comprises two lightweight aluminum-lined fiberglass-composite wrapped cylinders 12 for containing the compressed breathing gas. Such cylinders are commercially available as MSA Part No. 812631. Each of the cylinders 12 contain a total of 27 cubic feet of air (at STP) when fully charged to 3,000 psig. This provides a minimum of 15 minutes of service life as defined by 30 CFR Part 11 which contains the defining regulations for NIOSH. The air used in cylinders 12 must conform to CGA specification G-7.1 Type 1, Grade D or better.

Figure 3:
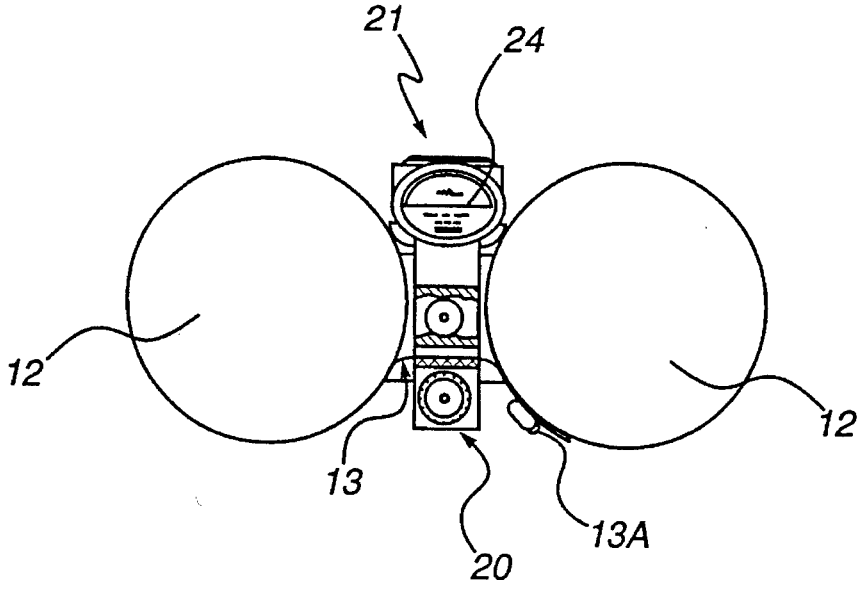
FIG. 3 is a top plan view of an air supply of the present invention.
Figure 5:
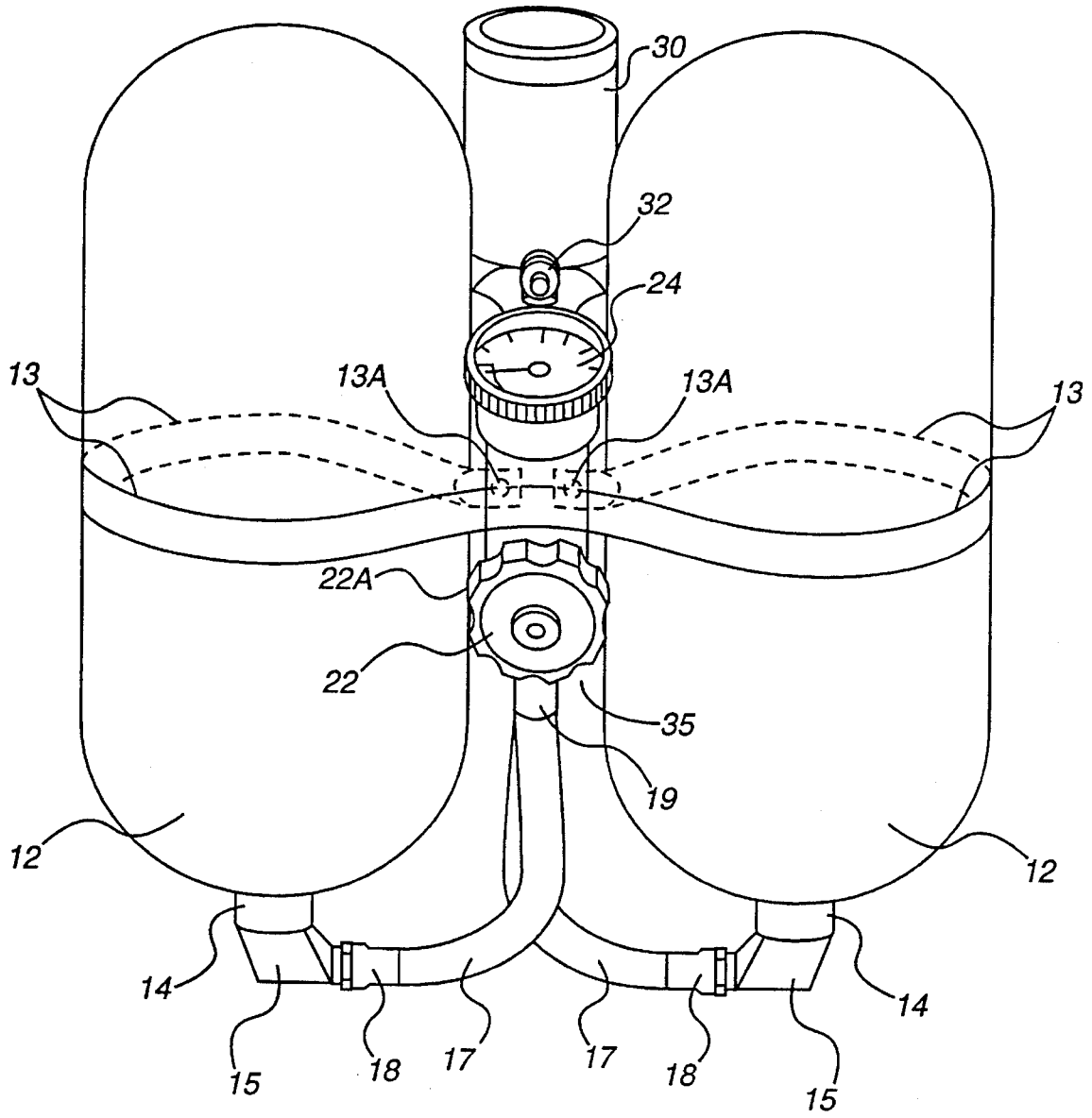
FIG. 5 is a front perspective view of an air supply of the present invention.

As shown in FIGS. 3 and 5, the cylinders 12 are connected to the manifold block 20 by the cylinder connecting band 13 and the cylinder band screws 13A. The cylinder connecting band 13 preferably comprises a steel or metal band 5/16 of an inch wide which may be fastened, via spot welds for example, to the manifold block 20. Elastomeric shock absorbers 25 disposed on the manifold block 20 are used for vibration isolation between the cylinders 12 that are tightened against the manifold block 20. The cylinder connecting band 13 prevents the cylinders 12 from flapping apart when the air supply 11 is removed from its carry pouch 54. The cylinder connecting band 13 operates to maintain the positions of the cylinders 12 relative to each other and the manifold unit 21 and thus aids in defining the envelope 35 defined by the cylinders 12. One or more cylinder connecting bands 13 may be employed to mount the plurality of air cylinders 12 comprising the air supply 11.

The second stage regulator 42 is connected to the air supply 11 via the high pressure hose 40 which is in gas-flow communication with the first stage regulator 30. The first stage regulator 30 is in turn connected to the manifold block 20 via a coupling 31 on the bottom of the first stage or high pressure regulator 30 that is threaded onto the cylinder filling port 28 on the manifold block 20. While the breathing apparatus 10 is shown in the drawings with both a high pressure and a low pressure regulator, the breathing apparatus 10 of the present invention may comprise only a first stage, high pressure regulator which would receive air at about 3000 psi from the cylinders 12 and deliver breathable air at about 60 psi to 80 psi to the facepiece 46 via hose 40.

The external air supply (not shown) connects to the first stage regulator 30 via low pressure hose 36 and the coupling 38. The low pressure hose 36 has a first end adapted to be connected in gas-flow communication with regulator 30 and a second end on which coupling 38 is disposed for easy connection to the external air supply hose (also not shown). A check valve 37 is disposed within the low pressure hose 36 between its first and second ends so the self-contained air supply cannot bleed from the system when the external air supply is disconnected, or the external air supply line gets cut or otherwise fails.

The high pressure hoses 17 and 40 and the low pressure hose 36 and the external air supply hose (not shown) are preferably made from neoprene because of its superior material properties. Neoprene is flame resistant, has good chemical resistance to many hazardous materials and has excellent weather resistant properties, especially in the cold and in ozone.

Figure 6:
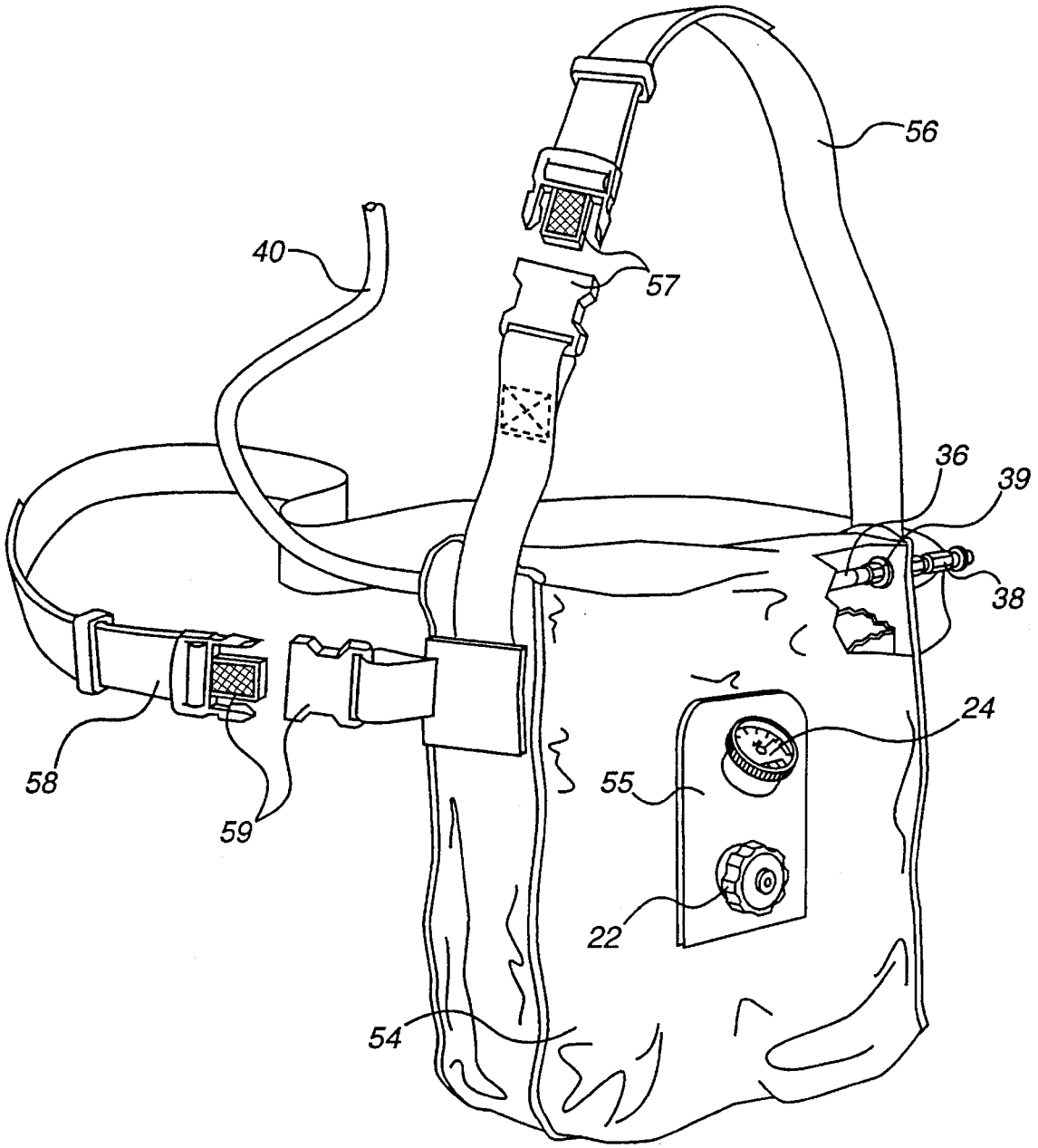
FIG. 6 is a front perspective view of an air supply of the present invention shown in its carry pouch.

As shown in FIG. 6, the carrier pouch 54, commercially available from MSA (Part No.812629), is preferably 12.8 inches in height by 10.5 wide by 4.6 inches deep. The air supply 11 of the present invention which is carried in the pouch 54 thus has a profile which is lower and thinner than known air supplies which can be used for entering and exiting IDLH environments. The carry pouch 54 is constructed of urethane coated nylon and is attached to a two-inch wide shoulder strap 56 which is constructed of nylon webbing. The carry pouch 54 is attached to the waste belt 58 via belt loops sewn to the pouch 54 and slotted elastomeric grommets in snap-in buckle 59 for extra security. The pouch 54 slides on the belt 58 so the user can find the most comfortable position to locate the pouch 54. The shoulder strap 56 incorporates a snap-in buckle 57 to facilitate doffing.

The pressure gauge 24 is easily visible as it protrudes through an access port in an elastomeric wall 55 of the pouch 54 allowing the user to monitor the cylinder pressure without opening the pouch 54. The wall 55 may comprise natural or synthetic rubber, or a variety of other elastomeric materials such as neoprene. Additionally, the pouch 54 has a second access opening in the elastomeric wall 55 for the cylinder control valve wheel 22A, allowing easy access for the user to activate the self-contained air supply 11. The elastomeric wall 55 also has a third access hole through which the end of the low-pressure alarm 32 can protrude. The elastomeric wall 55 seals tightly around such components to prevent dirt from entering the pouch 54. As shown in FIG. 6, the low-pressure hose 36 exits the carry pouch 54 through the shoulder strap 56 where a large washer 39 holds the hose 36 in place. This construction allows the load of dragging the external air supply hose to be transferred to the carry pouch strap 56 and not to the mechanical components of the air supply 11.

In the preferred embodiments of the breathing apparatus 10 of the present invention, the flexible manifold 29 preferably comprises the manifold unit 20 and the flexible high pressure conduits or hoses 17. The block manifold unit 21 is preferably a block constructed out of hard-coat anodized aluminum for corrosion resistance. This arrangement allows the manifold block 20 to be placed substantially or completely within envelope 35. This in turn produces many of the advantages of the present invention as set forth in detail above. In addition to the cylinder valve 22, the manifold block 20 preferably houses a pressure "blow-out" disk 26 to relieve the air pressure within the air supply 11 before a rupture occurs therein if the air cylinders 12 are exposed to fire or other heat sources.

The breathing apparatus 10 of the present invention is a NIOSH approved device weighing less than 15 pounds and which operates satisfactorily within an air supply pressure range of 60–80 psig and with a maximum of 300 feet of external air supply hose. The breathing apparatus 10 is also a pressure-demand device, meaning it delivers respirable air to the user "on demand" and with positive pressure in the facepiece 46.

The air supply 11 is preferably carried by the user in the over-the-shoulder carry pouch 54 while in use, and is storable in a hard-shell carry case (not shown) when not in use. Should the external air supply be interrupted during operation of the breathing apparatus 10 as a combination SAR/SCBA, the user can quickly switch the breathing apparatus 10 from the SAR mode to the SCBA mode to access the air supply 11. Switching to the SCBA mode is accomplished by opening the valve 22 (which is preferably closed when using an external air supply to conserve the air stored in the cylinders 12) and disconnecting the low-pressure hose 36. Since the air supply 11 is actuated first, the user immediately has breathable air, none of which escapes into the external air supply line, because the low-pressure hose 36 contains a check valve 37 to prevent the escape of pressurized air into the external air supply line. The air supply 11 provides up to fifteen minutes of air for escape. NIOSH allows the breathing apparatus 10 to be used for entry into IDLH environments as long as no more than 20 percent of the self-contained air supply is used for entry.

When used as a combination SAR/SCBA, the breathing apparatus 10 can be connected to a large, compressed air cylinder or a bank of cylinders set up in cascade fashion (not shown). For longer duration air supplies, the breathing apparatus 10 also can be used with a compressed air supply that delivers respirable air to the user within the NIOSH/MSHA approved pressure range and flow rates.

Although the invention has been described in detail in the foregoing for the purpose of illustration, it is to be understood that such detail is solely for that purpose and that variations can be made therein by those of ordinary skill in the art without departing from the spirit and scope of the invention as defined by the following claims, including all equivalents thereof.

What is claimed is:

1. A wearable breathing apparatus comprising a plurality of air storage cylinders; a flexible manifold in gas-flow communication with each of the air storage cylinders; wherein the flexible manifold comprises a manifold unit and a plurality of flexible conduits, one flexible conduit connected between the manifold unit and each of the cylinders, a connector attached to the cylinders for mounting the manifold unit between the cylinders such that the manifold unit is at least partially disposed within an envelope defined by the exterior surfaces of the plurality of cylinders.

2. The breathing apparatus of claim 1 wherein the manifold unit comprises a block.

3. The breathing apparatus of claim 2 wherein the block is completely within the envelope.

4. The breathing apparatus of claim 1 wherein the flexible conduits comprise hoses.

5. The breathing apparatus of claim 1 wherein the flexible manifold further comprises a regulator in gas-flow communication with the manifold unit.

6. The breathing apparatus of claim 1 wherein the flexible manifold further comprises a pressure gauge in gas-flow communication with the manifold unit.

7. The breathing apparatus of claim 1 wherein the flexible manifold further comprises a low pressure alarm in gas-flow communication with the manifold unit.

8. The breathing apparatus of claim 1 wherein the flexible manifold further comprises a control valve in gas-flow communication with the manifold unit.

9. The breathing apparatus of claim 1 wherein the flexible manifold further comprises a regulator, a pressure gauge, a low pressure alarm and a control valve in gas-flow communication with the manifold unit such that they are at least partially disposed within the envelope.

10. The breathing apparatus of claim 9 wherein the regulator, the pressure gauge, the low pressure alarm and the control valve are completely disposed within the envelope.

11. The breathing apparatus of claim 1 further comprising a pouch for carrying the cylinders and the flexible manifold.

12. The breathing apparatus of claim 1 wherein there are two air storage cylinders.

13. The breathing apparatus of claim 1 further comprising a low pressure hose having a first end in gas-flow communication with the manifold unit; a hose coupling disposed on a second end of the low pressure hose; and a check valve disposed within the low pressure hose between the first and second ends thereof.

14. The breathing apparatus of claim 1 wherein the connector releasably secures the cylinders relative to each other.

15. The breathing apparatus of claim 14 wherein the connector comprises a band attached to the manifold unit.

16. A wearable self-contained breathing apparatus comprising a pair of air storage cylinders and a flexible manifold, each of the cylinders in gas-flow communication with the flexible manifold;

the flexible manifold comprising a manifold unit and a plurality of flexible conduits for providing gas-flow communication between each of the cylinders and the manifold unit;

a connector attached to the cylinders for mounting the manifold unit between the cylinders such that the manifold unit is at least partially disposed within an envelope defined by the exterior surfaces of the cylinders;

the flexible manifold further comprising a regulator in gas-flow communication with the manifold unit, a pressure gauge in gas-flow communication with the manifold unit, a low pressure alarm in gas-flow communication with the manifold unit, a control valve in gas-glow communication with the manifold unit; and a facepiece in gas-flow communication with the manifold unit for delivering a supply of air to a user of the breathing apparatus.

17. The breathing apparatus of claim 16 wherein the connector further comprises a band for releasably securing the cylinders relative to each other and to the manifold unit such that the regulator, the pressure gauge, the low pressure alarm and the control valve are at least partially disposed within the envelope.

18. The breathing apparatus of claim 17 further comprising a low pressure hose having a first end in gas-flow communication with the regulator; a hose coupling means disposed on a second end of the low pressure hose; and a check valve disposed within the low pressure hose between the first and second ends thereof.

* * * * *